US005694847A

United States Patent [19]

Kleist

[11] Patent Number: 5,694,847

[45] Date of Patent: Dec. 9, 1997

[54] INK CUPS FOR PAD PRINTING MACHINES, METHODS OF THEIR MANUFACTURING AND MACHINES INCLUDING SAME

[75] Inventor: Egon Kleist, Hanover Park, Ill.

[73] Assignee: Trans Tech America, Inc., Carol Stream, Ill.

[21] Appl. No.: 714,282

[22] Filed: Sep. 17, 1996

Related U.S. Application Data

[63] Continuation-in-part of Ser. No. 556,501, Nov. 13, 1995, which is a continuation-in-part of Ser. No. 449,817, May 24, 1995, Pat. No. 5,476,040.

[51] Int. Cl.[6] ..... B41M 1/10

[52] U.S. Cl. ..... 101/170; 101/169; 101/333

[58] Field of Search ..... 101/163, 167, 101/169, 170, 327, 333, 483

[56] References Cited

U.S. PATENT DOCUMENTS

| | | | |
|---|---|---|---|
| 4,557,195 | 12/1985 | Phlipp | 101/163 |
| 4,621,386 | 11/1986 | Hill | 15/104.04 |
| 4,905,594 | 3/1990 | Phillip et al. | 101/163 |
| 5,080,013 | 1/1992 | John | 101/169 |
| 5,272,973 | 12/1993 | Chojnacki | 101/167 |
| 5,476,040 | 12/1995 | Kleist | 101/163 |

*Primary Examiner*—Eugene H. Eickholt

*Attorney, Agent, or Firm*—Leydig, Voit & Mayer, Ltd.

[57] ABSTRACT

Ink cups of pad printing machines are produced by insert molding a flanged plastic cup body directly on a hard doctor knife blade ring of carbide whereby the mounting portion of the blade ring is embedded and mold-bonded with the cup flange. The resulting cup is included in a pad printing machine that includes an annular hold-down ring that engages directly and uniformly on the cup flange.

25 Claims, 9 Drawing Sheets

FIG. 9E
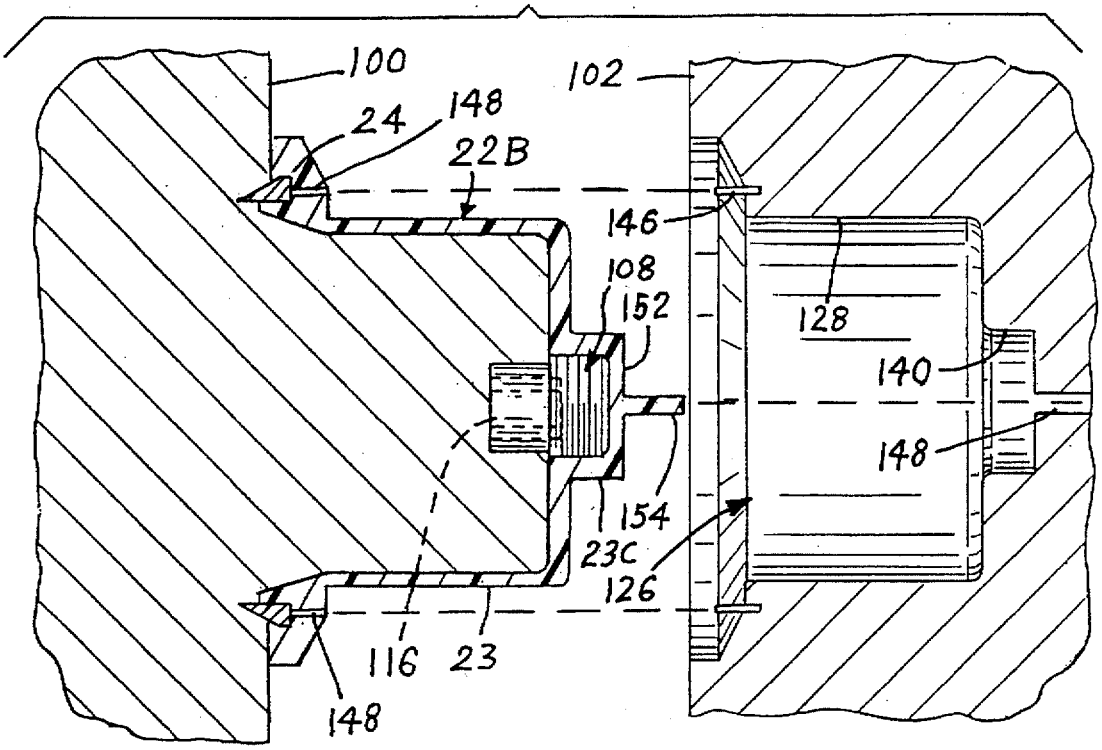
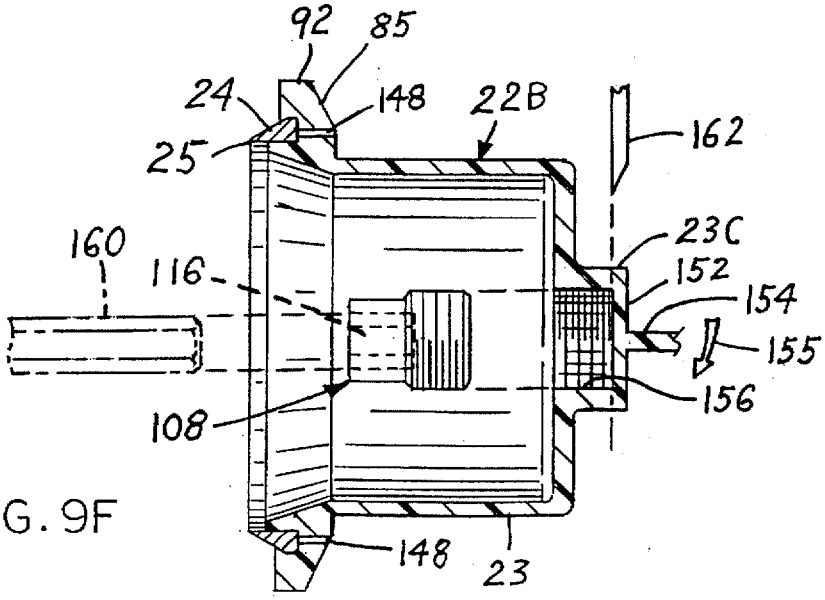
FIG. 9F

INK CUPS FOR PAD PRINTING MACHINES, METHODS OF THEIR MANUFACTURING AND MACHINES INCLUDING SAME

This application is a continuation in part of my copending application Ser. No. 08/556,501 filed Nov. 13, 1995 which is a continuation in part of my application Ser. No. 08/449,817 filed May 24, 1995 (now U.S. Pat. No. 5,476,040 issued Dec. 19, 1995). The disclosures of each of those applications is incorporated herein by reference.

FIELD OF THE INVENTION

The present invention relates generally to pad printing machines, and more particularly to the ink cups of such printing machines and methods of making such ink cups.

BACKGROUND OF THE INVENTION

Sealed ink cup pad printing machines comprise an ink cup which is supported in inverted fashion with a sealing and "doctoring" end surface thereof in abutment with a printing block or "cliché" that is mounted in reciprocating fashion for transferring ink in a predetermined pattern to a printing pad. The ink cup must contain the ink and apply it to a cliché with a doctoring action. To these ends the cup includes an ink retaining reservoir body with an open bottom end and a narrow annular surface around the bottom opening. The latter surface serves as a sliding seal between the ink cup and the cliché and as a doctor blade or "knife" for ensuring that only the engraved portions of the cliché carry ink to the printing pad pick-up site. U.S. Pat. Nos. 4,557,195 and 4,905,594 disclose examples of prior such machines and their disclosures are incorporated herein by this reference.

To ensure quality printing with pad printers, it is important that the doctor blade of the ink cup reliably scrape or wipe from the cliché plate all ink that is not within the engraving recesses. Consistently obtaining the clean wiping action has presented problems. Many clichés are made of metal, particularly for high volume reproduction of the same image. To obtain and maintain a sealing and wiping action for high volume long production runs, particularly with such metal-surfaced clichés, doctor elements typically have been formed of a very hard material, such as high speed steel, ceramic, high speed steel, or other hard metal, and have been finished to a very accurate planar surface, as by lapping.

Because of the precision required in forming and maintaining the doctoring edge of such cups in a precise planar condition during both manufacture and use of the cups, heretofore they have been relatively difficult and expensive to manufacture. For example, some such cups have been formed by machining the body of the cup and the doctor ring as one integral unit from a single block or casting of appropriate material such as high speed steel. Other teachings have been to mold the cup body of plastic with a ring receiving groove around its open end, as by injection molding, and then to position a doctor blade ring in that groove and retain the ring in position by use of an annular sealing member or material. Further proposals have been to provide the cup with a special flexible wall portion to allow the rim in which a doctor ring is seated to flex relative to the main body of the cup. It is also known to mold a plastic cup, then machine an annular ring-receiving groove around its open end, thermally shrink the cup by means of a cooling step, insert the doctor ring, and allow the cup to expand and frictionally engage and retain the ring. Still other approaches have utilized relatively complex clamping arrangements which engage and retain a ring upon insertion and rotation of the ring in a groove of the cup. The foregoing designs for and methods of making the ink cups all are relatively complex and expensive.

OBJECTS AND SUMMARY OF THE INVENTION

It is an object of this invention to provide an improved ink cup for pad printing machines which lends itself to substantially more economical manufacture.

It is another object of this invention to provide a method for economically manufacturing such ink cups, and particularly for economical manufacturing of such ink cups which have doctor blades of precise configuration and precise location relative to other portions of the cup.

It is a further object of this invention to provide pad printing machines with low cost ink cups having doctor blades of hard materials and which provide a long service life of high quality doctoring of opposed clichés.

It is another object of this invention to provide low cost ink cups in pad printing machines while maintaining uniform application of contact pressure with an underlying cliché throughout the periphery of the doctor blades.

It is a more specific object of the present invention to provide improved ink cups for and in pad printing machines, and particularly in such machines which include an annular hold-down, e.g., as disclosed in my said U.S. Pat. No. 5,476,040.

An ink cup for a pad printing machine is produced very economically, i.e. at low cost, by molding a hollow plastic ink cup body directly onto a hard doctor blade such that the doctor blade is affixed to the cup body by the molding step, with the doctor knife portion defining the open end of the cup and the distal doctoring edge of the knife projecting outward to provide the sealing and doctoring surface of the ink cup. During the molding step, the distal edge portion of the doctor knife blade is firmly and accurately seated and held against a die block. The cup body is molded onto the body portion of the thus-positioned doctor blade by injection molding in an injection molding machine. The doctor ring thus is mold-bonded in the cup in an accurately defined position for an accurate configuration of the completed cup.

In a presently preferred embodiment, the cup is formed in a hat-shaped configuration. Thus, the cup body includes an external flange that is molded onto a hard doctor ring, preferably of carbide, and has a cylindrical cup wall of an outside diameter that is less than the inside diameter of the doctor ring. Further, the doctor ring preferably has an embedded body portion of a configuration to ensure mechanical interlocking engagement with the molded-on plastic body.

The subject cup is particularly beneficial for use in a pad printing machine which includes a hold-down mechanism that includes an annular thrust collar in substantially continuous uniform contact with the upper flange surface around the cup whereby downward pressure is applied on the cup flange by the thrust collar substantially uniformly along the entire circumference of the cup directly over the doctor blade ring, such as disclosed in the aforementioned U.S. Pat. No. 5,476,040.

BRIEF DESCRIPTION OF THE DRAWINGS

FIGS. 9A through 9F illustrate steps in the making of an ink cup employing teachings of this invention.

Figure 1:
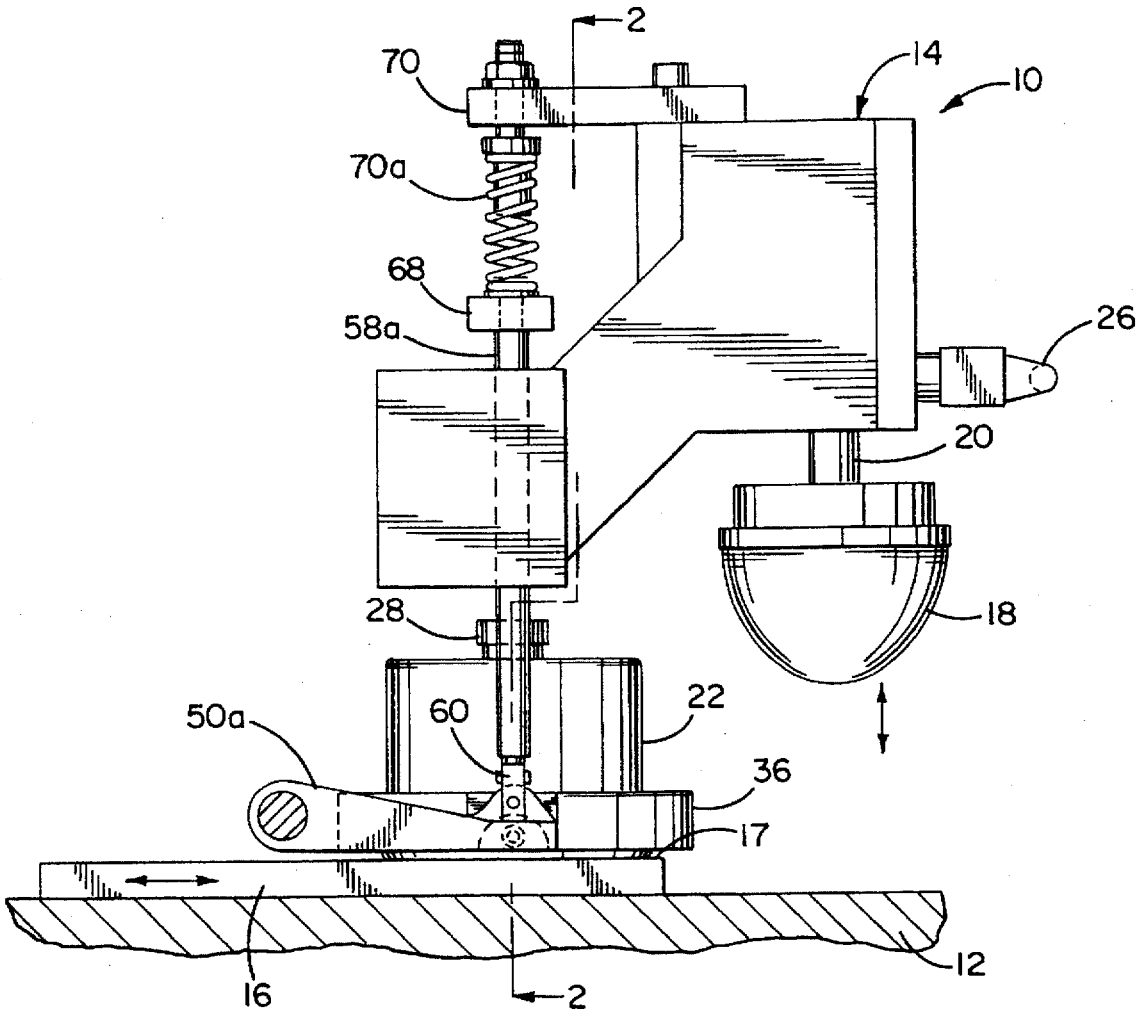
FIG. 1 is a side view of the printer section of a pad printing machine including an ink cup embodying teachings of this invention.
Figure 2:
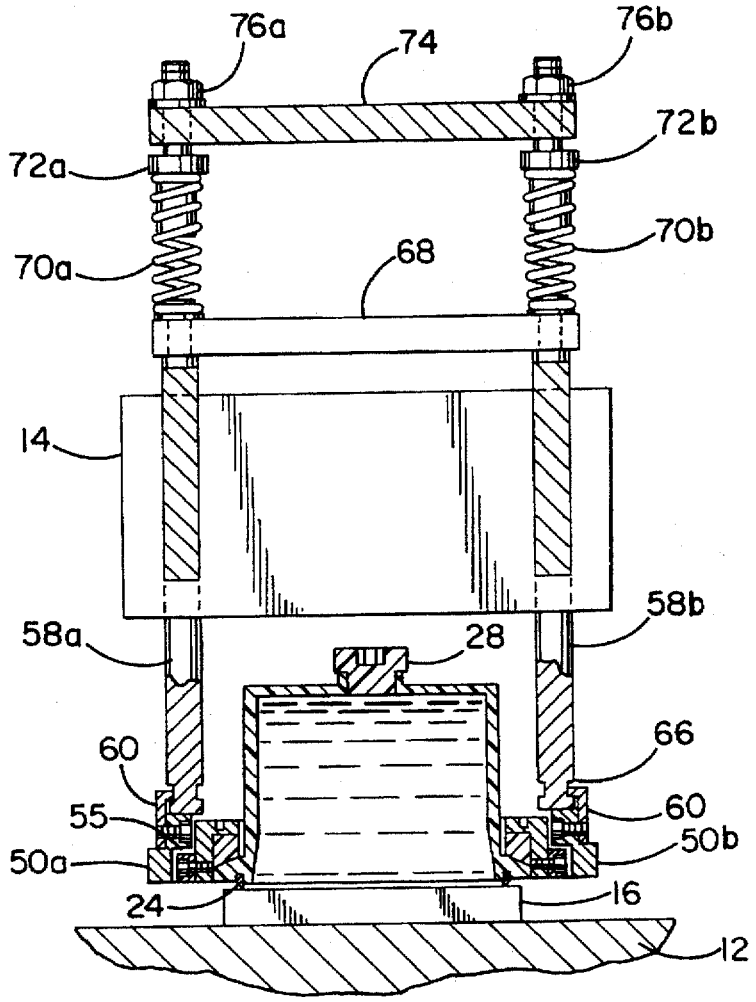
FIG. 2 is a vertical view, partially in section, taken generally along the broken line 2—2 of FIG. 1.

While the invention is susceptible to various modifications and alternative constructions, a preferred embodiment has been shown in the drawings and will be described in detail. It will be understood, however, that there is no intention to limit the invention to the specific embodiment, but on the contrary the intention is to cover all modifications, alternative constructions and methods and equivalents falling within the spirit and scope of the invention.

DESCRIPTION OF THE PREFERRED EMBODIMENT

Figure 3:
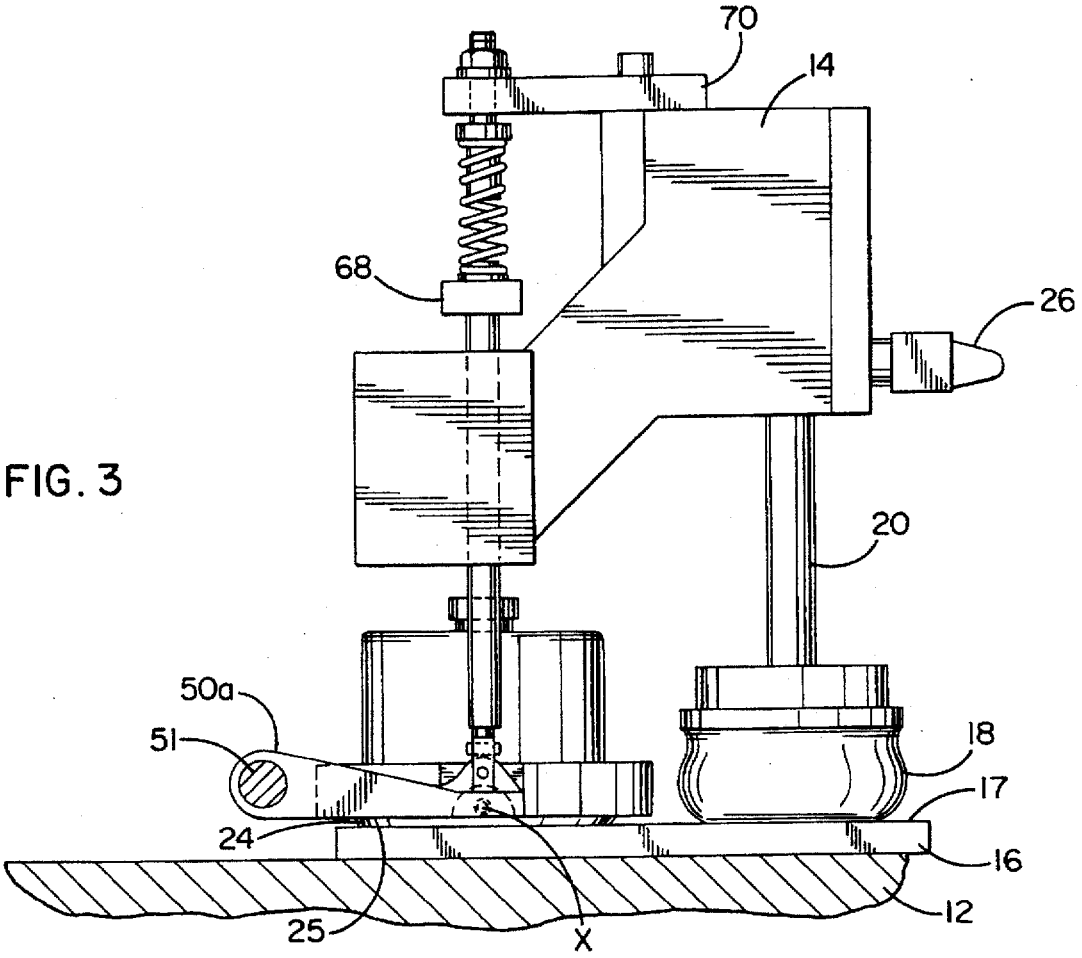
FIG. 3 is a view of the apparatus of FIG. 1 with the cliché and the printing pad advanced to their impression transferring positions.

The drawings illustrate the ink holding and transfer components of a pad type printing machine 10. The machine includes a support frame of which the illustrated portions include a base 12 and upper frame portion 14 both of which are components of an appropriate frame structure for such machines, such as is known in this art. A flat gravure plate 16 is suitably mounted on the plate bed for reciprocation between a retracted inking position as in FIG. 1 and an extended transfer position as seen in FIG. 3. This plate, also commonly known as a cliché, may be of any suitable material, typically being metal, plastic or a combination thereof and normally being chemically etched or photo-engraved on its upper surface 17 with the text, logo or other pattern which is to be printed by the operation of the machine 10. A transfer pad 18 of appropriate configuration is mounted on a support rod 20 for suitable vertical reciprocating motion. With the cliché 16 extended, the pad 18 is pressed against the engraved area of the cliché as in FIG. 3 to receive the ink pattern therefrom and then is retracted upward. While the cliché subsequently is retracted as in FIG. 1 for re-inking, the pad 18 is advanced against a recipient object to transfer the ink pattern thereto, in a known manner by an appropriate coordinated driving mechanism.

An ink cup 22 is mounted over the cliché to serve as a supply reservoir for the printing ink. The cup includes a molded plastic reservoir body 23 with an open lower end and a separate doctor blade element 24 mold-bonded in the lower end of the body 23 around its opening as described further below. The cup 22 thus has an open bottom for free access of the ink to the upper surface 17 of the cliché 16 and has the doctor blade or "knife" ring 24 defining its sealing and doctoring lower end. This blade 24 must be maintained in intimate contact with the adjacent surface 17 of the cliché 16 at all times to form a seal for retaining the ink supply in the cup 22 and to scrape the surface 17 clean of all ink thereon as the cliché is advanced from the loading position of FIG. 1 to the transfer position of FIG. 3, except only for the ink in the depressions engraved or otherwise formed in the upper surface to define the print pattern. As the doctor blade presents a very narrow edge surface 25 against the cliché and is subject to continual rubbing action by the cliché as the cliché is reciprocated, the knife blade ring 24 is formed of hard material or provided with a hard lower edge portion, such as of carbide.

It is very important that the contact edge surface 24 of the knife ring and the upper surface 17 of the cliché be accurately formed and maintained in suitable compressive engagement with one another throughout the length of the knife blade, i.e. throughout the circumference of the blade ring. Slight variations in either surface, on the order of a few microns, or even variations in the compressive force therebetween along different portions of the circumference of the ring, can cause leakage of the ink or leave a film of ink in undesired areas of the exposed portions of the cliché (sometimes referred to as "fogging"), and/or cause scratches or other undesirable wear patterns on the cliché, which can adversely affect the useful life of the relative expensive clichés. Thus, it is highly desirable that intimate but uniform pressure contact be maintained between the ring and the surface of the cliché despite non-planarity of either surface, such as may occur due to minor errors of manufacture and/or as a result of warping during use.

An adjustment handle 26 is provided at the front of the apparatus to normally raise the support rod 20 for insertion of a cup 22.

A removable filler breather plug 28 is provided in the upper end of the ink cup, such as by threaded engagement in the top boss or collar 23C. The cup 22 also includes an annular flange 34 which extends radially outward around its lower open end.

As discussed in greater detail in the aforementioned patent application Ser. Nos. 08/449,817 (now U.S. Pat. No. 5,476,040) and 08/449,847, which are incorporated herein by reference, the illustrated hold down mechanism for maintaining the cup 22 in position with its doctor blade 24 in desirable continuous engagement with the cliché 16 includes: A thrust collar 36 which fits in superposed relationship over the flange 34; the collar 36 is pivotably mounted at diametrically opposite sides by a pair of interconnection mechanisms **40*a* and 40*b* for pivotal movement about an axis "X" which is parallel to the surface 17 and perpendicular to the reciprocating path of the cliché; and, the bearing structure for applying external downward forces to the thrust collar 36 and thus to the cup 22 is of a design to assure that these forces are applied to the collar at points spaced forwardly and rearwardly of the transverse pivot axis X (see FIG. 3**) and not directly on the pivot axis, to provide a restraining or stiffening action which resists fore-and-aft tilting tendencies of the cup as the cliché reciprocates.

Down-pressure forces are applied to the cup components by a pair of pressure rods **58*a*, 58*b* which are disposed in parallel, upright arrangement thereover. The forces of these rods are applied through clamping fingers 50*a* and 50*b* which have pressure portions 52 including bearing surfaces 54 that engage spaced bearing surfaces 48*a* and 48*b* of elements 42 which are affixed to the thrust collar 36. Slight vertical relative movements are allowed between the two pressure rods and hence between the two sides of the collar 36 to allow tilting adjustment of the collar and hence of the cup 22 transversely of the center longitudinal horizontal axis which is generally parallel to the direction of reciprocation of the cliché and orthogonal to the aforementioned X axis. To this end the pressure rods 58*a* and 58*b* are mounted for vertical movement in the machine frame portion 14. A pressure plate 68 is mounted on the upper ends of these two rods 58***a* and 58*b*. A pair of compression springs 70*a*, 70*b* engage the upper ends of the respective rods 58*a*, 58*b* and have their upper ends confined by respective adjustable tension screw mechanisms 72*a*, 72*b* which are supported in an upper spring plate 74 that is affixed to the machine frame 14. The compressive force applied by each spring 70*a*, 70*b* can be adjusted, such as by threaded adjustment of the respective mounting nuts shown at 76*a*, 76*b*.

The thrust collar 36 comprises a rigid upper pressure ring 80, to which the bearing components 42 are affixed, and a lower pressure distribution force-transfer ring 82. The upper pressure ring preferably is formed of metal, particularly steel, and is rigid to avoid any significant deformation or distortion under the forces applied during operation of the subject machine. The pressure distribution ring 82 is formed of a material which is relatively rigid and machinable to close tolerances but which also has slight compressive resilience (high durometer values), to provide substantially full surface abutting engagement with the cup flange substantially all around the cup. It also must be compatible with printing inks and have high chemical resistance. As further described in the aforementioned application Ser. No. 08/449,817 (U.S. Pat. No. 5,476,040), examples include a hard machinable plastic or a light metal such as aluminum of high durometer and hence having slight but only slight compressive resilience. The UHMW PE described therein presently is the preferred material for the pressure distribution ring.

The pressure distribution ring 82 is affixed within the upper pressure ring 80 with these two pressure rings having continuous annular abutting surfaces at the generally horizontal interface 83 therebetween. The lower annular surface 84 of the ring 82 is machined after assembly of the ring 82 into the rigid ring 80, to very accurately form the lower exposed surface 84 to a configuration for close mating engagement with the upper annular surface 85 of the cup flange 34. To facilitate such accurate conformation of these surfaces for such close mating engagement, the surface 85 of the cup flange 34 is formed by precision molding, typically with supplemental machining, of an injection moldable plastic of substantially the same or greater hardness than the pressure distribution ring and which is compatible therewith. These surfaces 84 and 85 each extend continuously around the circumference of the cup 22 and each is very accurately formed, e.g. to tolerances on the order of the 0.02–0.05 mm and 0°15', such that they are in mating contact around the entire circumference to effect essentially uniform force transfer of the hold-down forces from the hold-down superstructure to the flange of the cup closely adjacent the lower edge of the cup and virtually directly over the circular doctor blade 24. One specific example of a pressure distribution ring 82 formed of a linear high density polyethylene material, namely a UHMW PE, and a rigid pressure ring 80 of 4140 prehardened steel, as further described in the aforementioned application Ser. No. 08/449,817 (U.S. Pat. No. 5,476,140), are of beneficial use with an ink cup 22.

Figure 4:
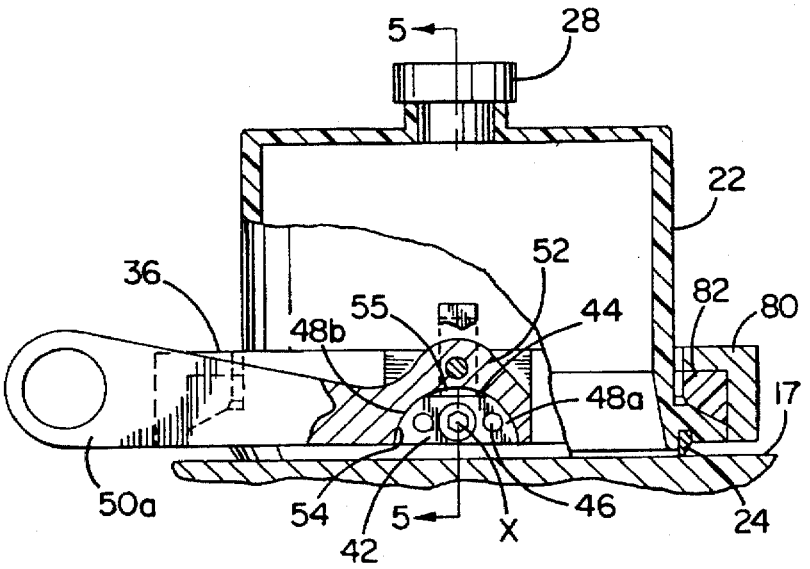
FIG. 4 is an enlarged side view of the ink cup and related hold down components of the apparatus in FIG. 1, with portions shown in section.
Figure 5:
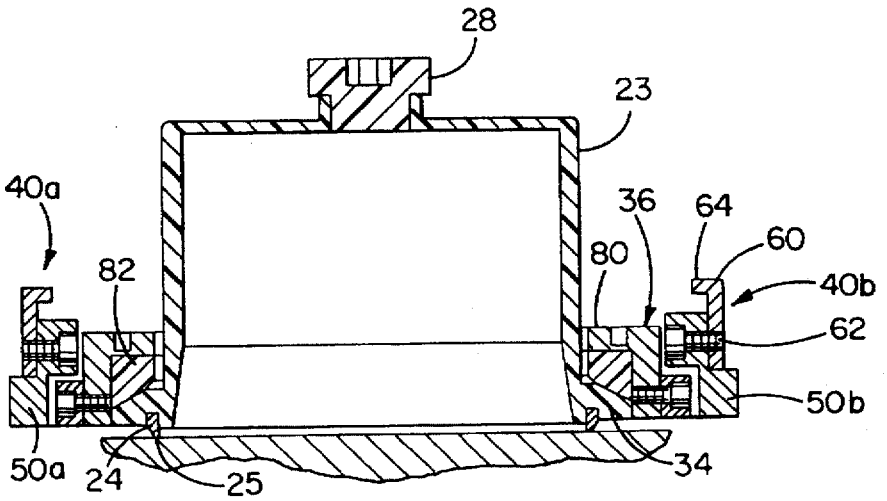
FIG. 5 is a sectional view taken generally along line 5—5 of FIG. 4.
Figure 6:
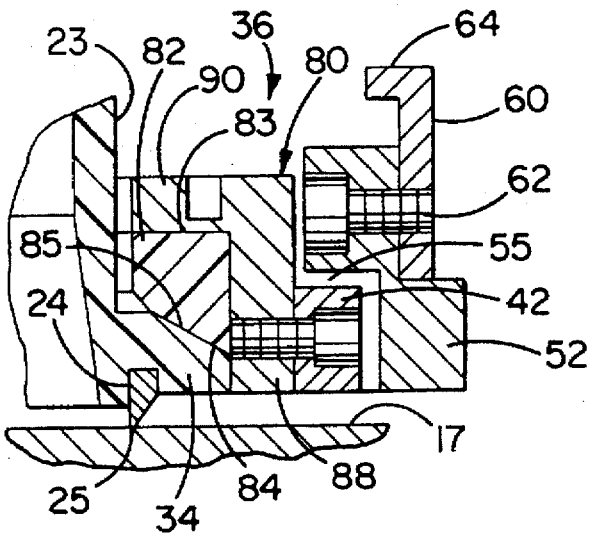
FIG. 6 is a further enlarged sectional view of the force transfer elements in the lower right hand portion of FIG. 5.
Figure 7:
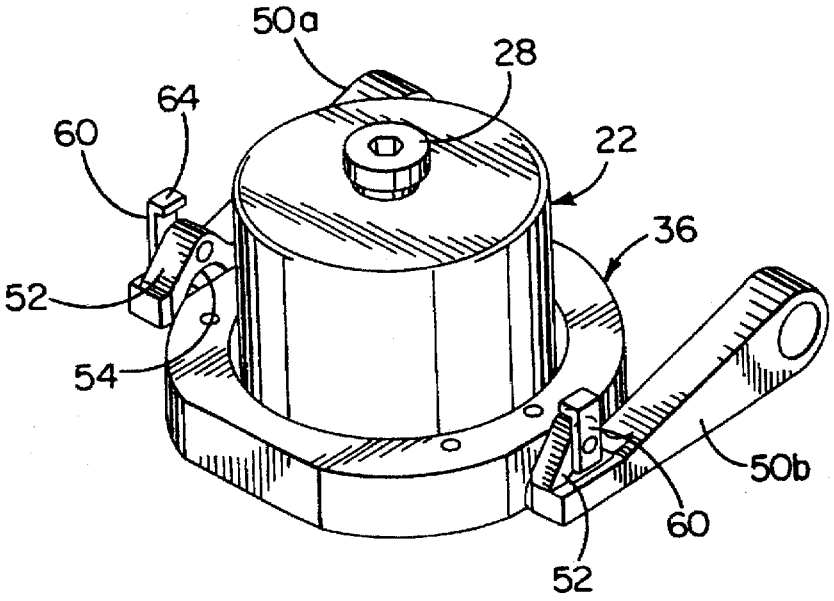
FIG. 7 is a perspective view of the ink cup and certain related hold down apparatus in FIG. 1.
Figure 8:
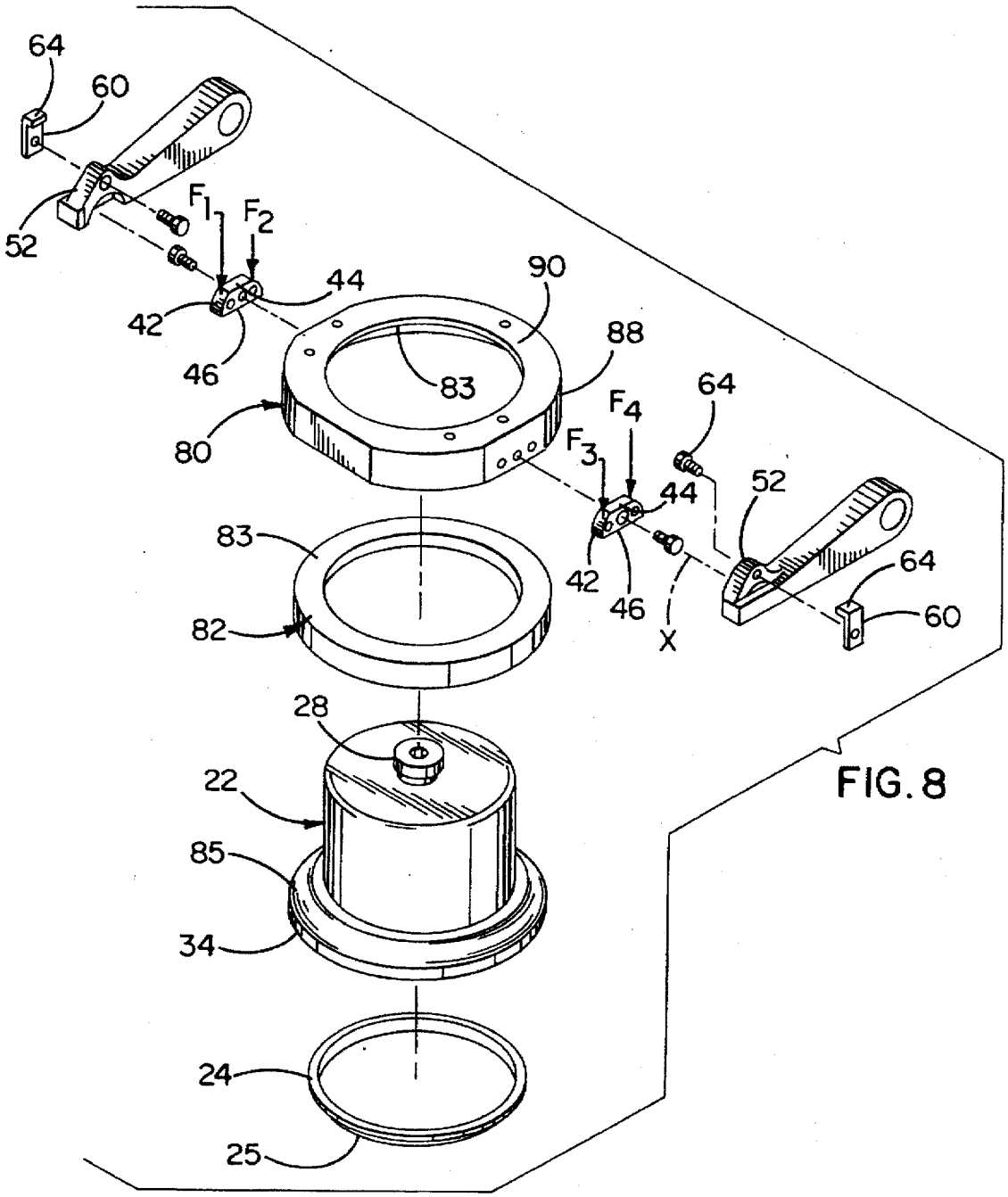
FIG. 8 is an exploded view of the apparatus of FIG. 7.

The upper pressure ring 80 includes an axially extending outer annular flange or leg 88 and a radially extending annular leg or flange 90, thereby being generally L-shaped in cross-section as seen in FIGS. 4–6. The pressure distribution ring 82, having radial dimensions to match the I.D. of the inner flange 90 and to be press fit with the outer flange 88 while seating fully on the inner surface of flange 90, was press-fit into the rigid pressure ring to form the thrust collar. The exposed axial end surface of the ring 82 then was machined, after assembly with the ring 80, at an angle of about 30° to a plane normal to the longitudinal axis of the outer ring 80, to provide a continuous truncated conical pressure surface 84 which was parallel to the upwardly exposed truncated conical surface 85 defined by the cup flange 34. The matching circumferential conformation and accuracy of each of these mating conical surfaces ensured essentially continuous contact therebetween around the entire circumference of the cup 22. In this example, the critical planar surface dimensional tolerances were on the order of 0.02 mm or 0.03 mm, and the tolerance for the pressure ring surface 84 was plus 0°0', minus 0°7', and the tolerance for the cup surface 85 was plus 0°7', minus 0°0'. The angle tolerance values assured that if there is any divergence of these conical surfaces, then abutment therebetween will occur first at the radially inward edge of their interface, thereby assuring maximum force transfer closest to the cup wall and thus closest to axial alignment with the subjacent doctor blade 24.

While the pressure distribution ring 82 is quite hard, the small degree of resilience which it affords assures substantially uniform force transfer around the entire circumferential interface 84/85 of the thrust ring and the cup flange regardless of minor variations within the machining accuracy of the two components. This assures essentially uniform transfer of force all around the cup to all portions of the doctor blade 24 and thus uniform contact pressure of the blade against the cliché throughout the circumference of the blade.

The radial dimensions of the outer surface 92 of the cup flange 34 and the inner surface 94 of the outer flange 88 of the ring 80 also were the same to assure a close fit to assist in avoiding rocking movement of the cup relative to the thrust collar 36.

Figure 9A:
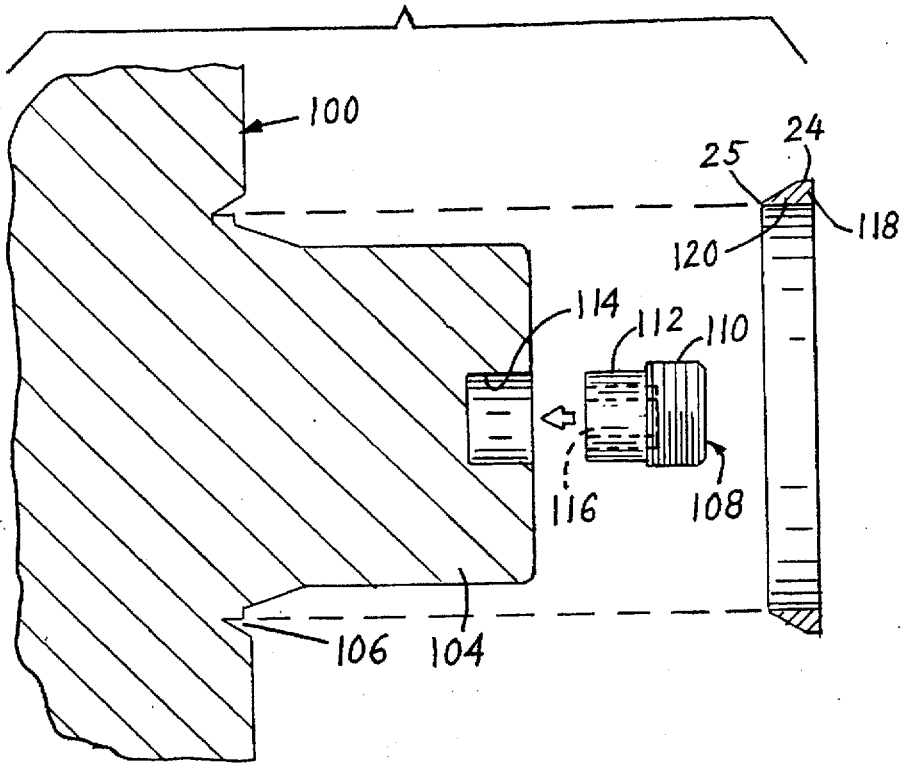
Figure 9B:
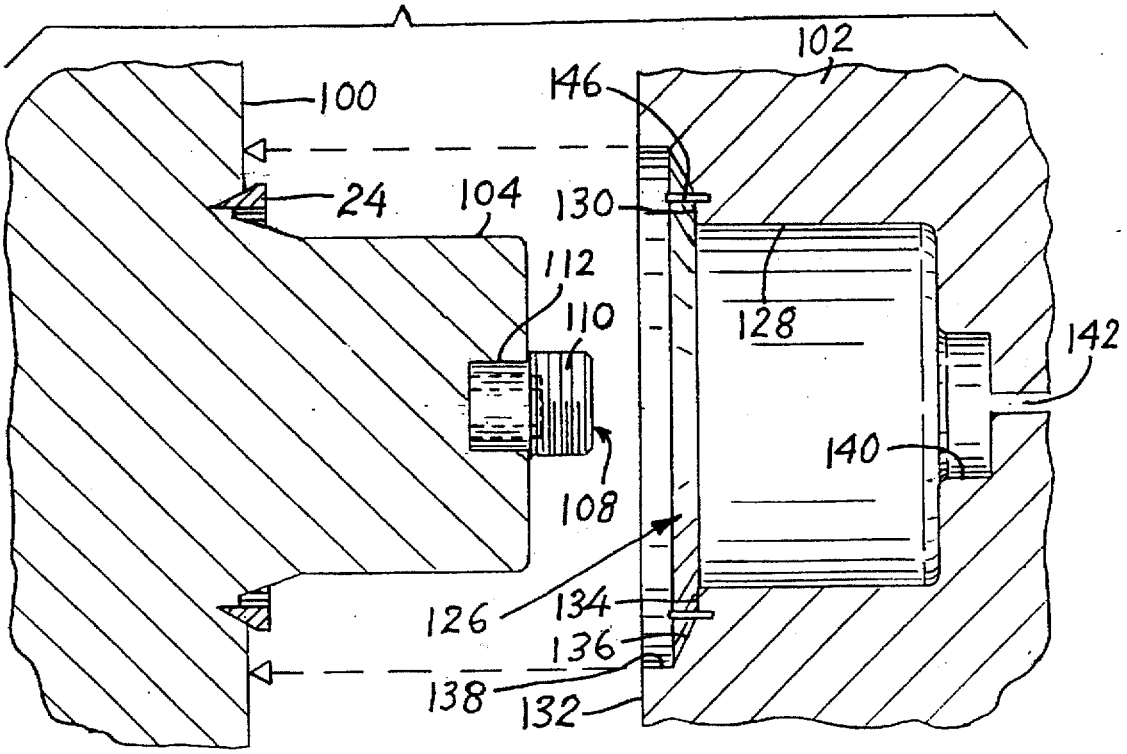
Figure 9C:
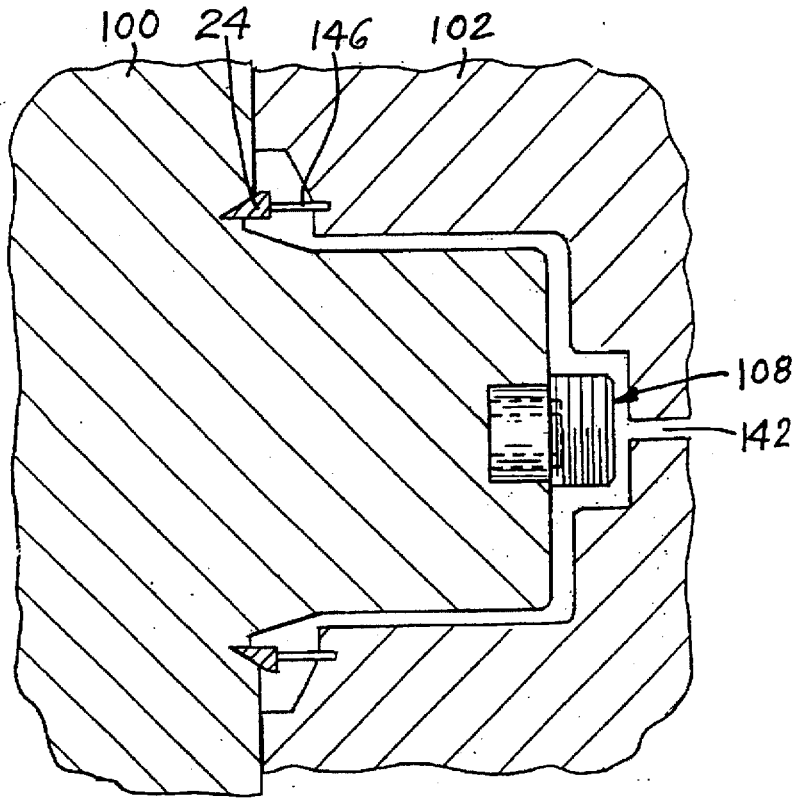
Figure 9D:
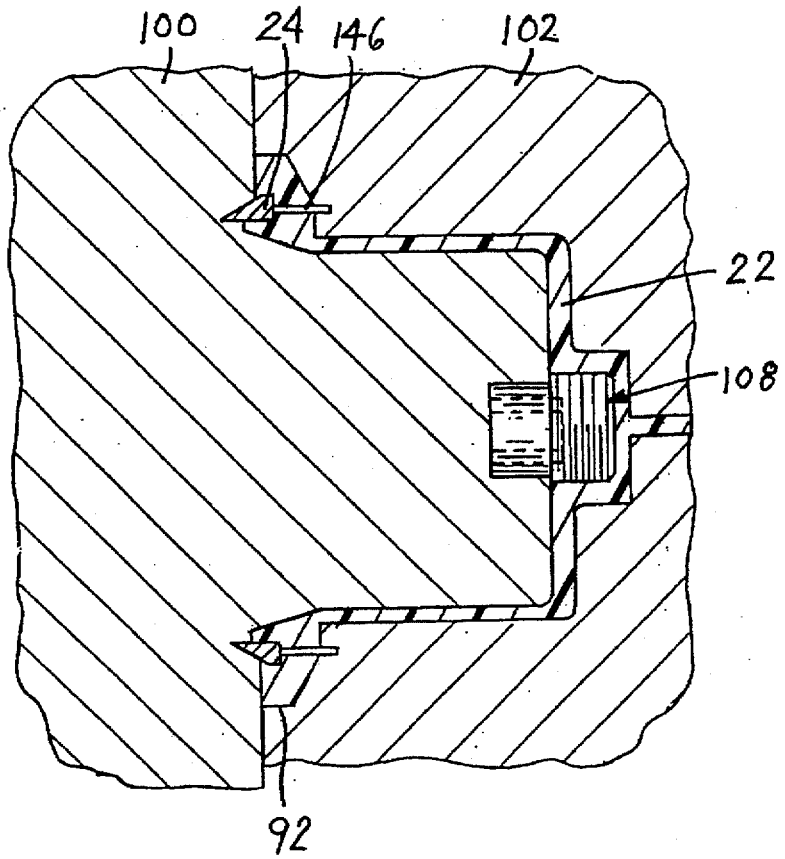
Figure 10A:
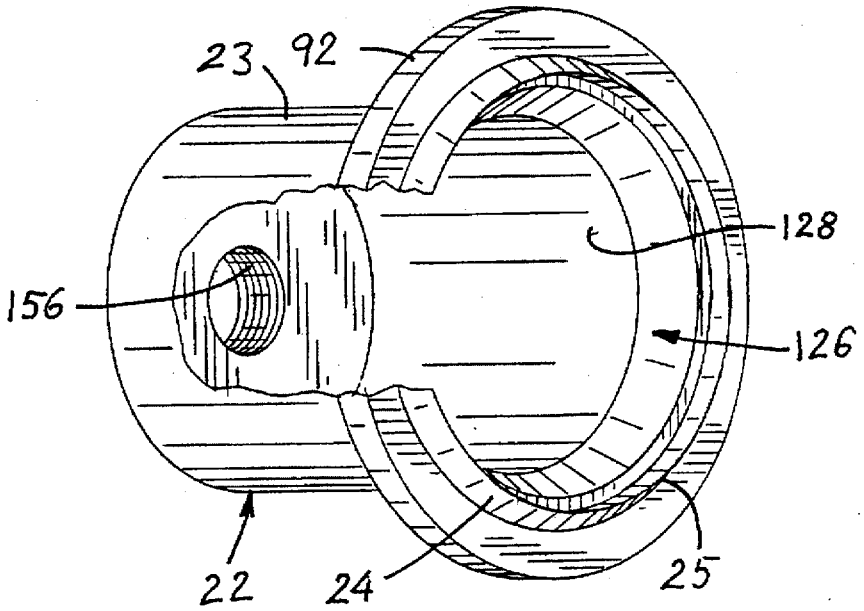
FIGS. 10A and 10B are perspective views of an ink cup embodying teachings of this invention.
Figure 10B:
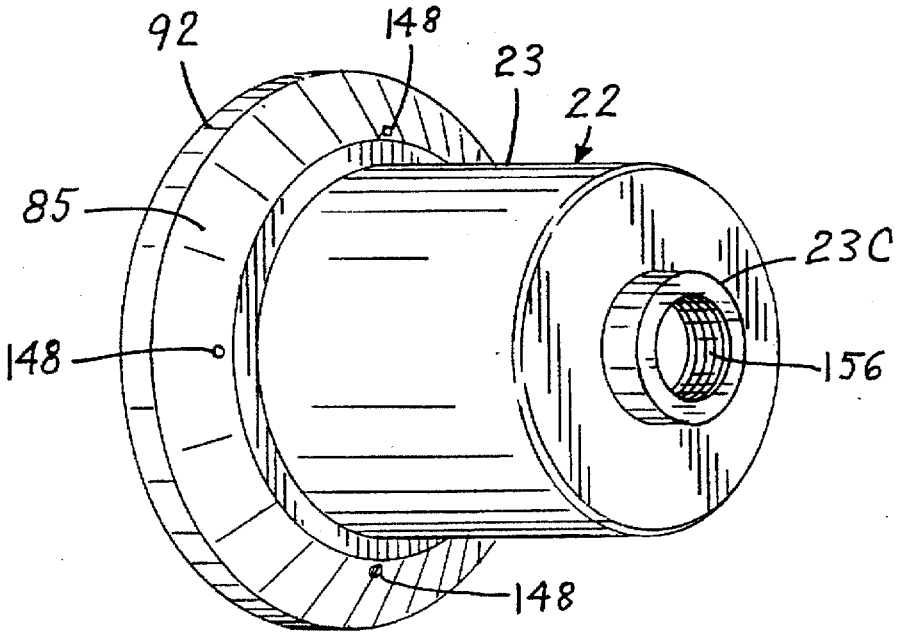

FIGS. 9A through 9E illustrate, somewhat schematically, a method of injection molding of an ink cup 22 in accordance with teachings of this invention, and FIGS. 10A and 10B further illustrate the resulting unique inventive ink cup.

With reference to FIGS. 9A–9E, the illustrated practice of the method utilizes a male die 100 and a female die 102 which are of appropriately configurations for performing the subject method and producing the subject cups in a conventional injection molding machine. The male die 100 includes a circular cylindrical projection 104 of an appropriate configuration corresponding to the desired internal configuration of the cup body 23. An annular V-shaped notch 106 is provided concentric with the body portion 104 and spaced radially outward of the body 104 in the area which will correspond to the flange 34 of the cup 22. The notch 106 is of a configuration to afford close-fit seating and accurate positioning of a doctor knife end portion of a doctor blade ring as referred to further below. A threaded die plug element 108 has external threads 110 and an extension 112 for ready sliding engagement and mounting in a socket 114 in the outer end of the body 104. The extension 112 has an internal socket configuration 116, e.g. of polygonal cross-section, for mating engagement with an appropriate tool to remove the plug from a molded cup, as also referred to further below.

An annular doctor blade ring 24 is provided, having been preformed of material appropriate for providing the desired sealing and doctor knife edge functions when operated against a cliché in a pad printing machine. As best seen in FIG. 9A, in cross-section the doctor knife ring 24 includes a generally rectangular body portion 118 from which extends a tapered knife portion 120 that extends to the distal sealing and doctoring edge 25.

As perhaps best seen in FIGS. 9B and 9C, the female die 102 is provided with a cavity 126 of a configuration to define the desired outer configuration of the cup body 23. In the illustrated embodiment, the recess 126 includes a cylindrical main cavity 128 to define the outer surface of the outer end of the main reservoir body portion 23 of the cup 22, a surrounding annular flange-defining cavity configuration 130 around the outer end of the main body cavity 128 and extending to the outer mating die face 132. The flange-defining cavity 130 includes a first annular radial surface 134 extending outward from cavity 128, a tapered shoulder surface 136 and a cylindrical wall surface 138 appropriate to forming the outer surfaces of the flange 34 of the cup body 23. A smaller coaxial cavity 140 extends inward from the cavity 128 for forming the boss or collar 23C at the upper or "closed" end of the cup 22. A coaxial sprue hole 142 is included to admit the flowable plastic during the injection molding step.

A plurality of positioning pins 146 are fixed in the die 102 to extend axially forward from the surface 134 in alignment with the doctor ring notch 106 of the die 100. The pins are positioned in equal-angular spaced relationship to one another around the annular flange cavity 130. In the presently preferred embodiment, there are four such pins arrayed at 90° spacings; see also the resulting holes 148 in the cup 22 as illustrated in FIG. 10B.

To form a cup 22 in accordance with this invention, the plug 108 is positioned in the die socket 114 and a doctor knife ring 24 is preliminarily positioned with its knife-edge portion 120 in the notch 106, as seen in FIG. 9B. The dies 100–102 are then closed to the position seen in FIG. 9C wherein the pins 146 abut and press against the doctor knife ring 24 to insure full seating and thus accurate positioning of the doctor knife ring relative to the cup body to be molded thereon. The outer doctor knife edge portion of the ring 24 thus is covered and protected by being seated in the notch 106. At least the rectangular body portion 118 and preferably also a contiguous part of the narrower tapered outer surface of the ring remain exposed within the mold cavity, as illustrated in FIG. 9C.

The cavity between the respective die portions defines the primary body, the flange and the boss of the cup 22 to be formed. In a typical injection molding operation, as carried out with a typical plastic injection molding machine, the dies are heated and a suitable heated and flowable plastic is injected through sprue hole 142 to fill the cavity space between the dies 100 and 101 and thereby to form the plastic body of the cup directly on the exposed portion of the accurately prepositioned doctor knife ring 24. Thereby this portion of the knife ring is encompassed by and embedded in the plastic body.

After the die has been sufficiently cooled to cause the injected plastic to solidify, the dies are opened as by retracting the die 102 from the die 101 in a direction parallel to the axis of the die forms. This exposes the cup blank 22B on the die 100 as seen in FIG. 9E. At this point, the cup blank 22B is essentially of the final form of the cup 22 with the doctor knife ring 24 securely bonded in the molded plastic cup body 23 in a precisely accurate position relative to the body 23 and particularly relative to the flange 34 and its reference surface 85. At this stage the cup blank includes an end wall 152 over the outer end of the plug 108 and a sprue "stick" 154 of the plastic extending therefrom.

The cup blank then is removed axially from the die 100, carrying with it the plug 108. Either prior to or after such removal, the sprue stick is removed, as by breaking, as indicated by the arrow 155 in FIG. 9F. The plug 108 is removed from the cup blank, as by inserting an appropriate socket tool, as at 160, into the recess 116 and thereby unscrewing the plug from the internal threads 156 formed by molding of the plastic thereagainst during the injection molding step.

Subsequently, the end wall 152 is removed, e.g. by a cutting tool as indicated conceptually at 162 in FIG. 9F, to expose the internal threads 156 through the outer end of the boss 23C for threadable insertion of a closure cap such as the cap 28 illustrated in FIG. 4. This closeable opening of course serves for filling the cup with ink when the cup is in position against a cliché.

It has been found that molding the plastic cup body directly onto the doctor blade ring as described above results in highly accurate positioning of the doctor knife blade relative to the cup body and in secure permanent affixation of the blade to the body at such desired position. It is believed that the shrinkage of the plastic during cooling and solidification creates firm gripping stress of the molded plastic blade on the blade ring. The gripping engagement resulting from the molding of the plastic body 23 directly onto the ring 24 is referred to herein as "mold-bonded". The doctor blade ring preferably is embedded by the plastic over the entire body portion 118 and over an adjacent part of the knife blade portion 120 which is of lesser cross-sectional area. The latter insures a positive interlocking affixation of the doctor blade 24 in the overmolded cup body 23. The affixation of the ring also may be enhanced by varying the configuration of the body portion 118 of the knife blade, e.g. by providing an enlarged or angled portion or holes or otherwise modifying the configuration at or adjacent the end portion which is embedded in the molded plastic. However, the latter has not been found to be necessary and in most or all instances would add to the complexity and costs of forming the doctor knife component.

The resulting completed ink cup 22 as illustrated in FIGS. 10A and 10B thus may be formed in a very expeditious and economical manner. It is to be noted that in this preferred embodiment, the doctor blade ring 24 is of a larger internal diameter than the outside diameter of the main body portion 23 of the cup. That is, the doctor knife ring is embedded in the annular flange 34 outboard of the body 23 and is in substantially axial alignment with the pressure forces applied to the flange surface 85 by the pressure ring arrangement 80, 82 in a pad printing machine as described hereinabove. This axial alignment or co-location of the blade ring and the pressure ring and the fact that the knife ring is in the flange insure that the respective portions of the cup will flex and yield slightly to allow the doctoring knife edge 25 to conform to the surface of a cliché against which the cup moves during printing operations. That is, it allows the substantially equal distribution of the hold-down forces along the entire circumferential length of the doctor knife ring.

Depending upon the precision of the molding, supplemental machining may be desirable or necessary to overcome variations in critical dimensions and surface configurations arising from shrinkage of the plastic during cooking. Thus, critical external surfaces of the cup body 23 may be machined to secure accuracy of those surfaces as desired. In particular, the upper flange surface 85 and the outer cylindrical flange surface 92 typically have been machined to assure accurate mating engagement with pressure ring components such as the pressure rings 80, 82.

In one present example, an ink cup of the configuration of cup 22 has been made using a doctor ring 24 machined from a sintered carbide preform. The particular ring had a nominal inside diameter of 60 mm. In cross-section, the ring was about 5 mm in axial length, with a body portion 118 about 5 mm in radial thickness and 1 mm in axial length. The inner surface of the ring was of right circular cylindrical configuration parallel to the axis of the cup. The outer surface tapered at about 30° through the blade portion 120, i.e. from the body portion 118 to the edge 25. The corresponding cup body 23 was of about 49 mm I.D., 53 mm O.D. and had a flange 34 of about 76 mm O.D. with a tapered surface 85 having an I.D. of about 58 mm and extending at an angle of about 30° relative to a plane normal to the longitudinal (vertical) axis of the cup. This cup body 23 was of an overall height of about 50 mm, which included the 3 mm height of the threaded boss 23C. The reservoir cavity of the plastic body was of an overall depth of about 41.5 mm (measured axially), with the inner surface adjacent the outer end (within the flange 34) tapered outwardly at about 16° to the axis of the cup. The end surface of the flange outward of the knife blade 24 was inset about 1 mm relative to the end surface of the portion of the flange inward of the knife blade. The flange 34 had an axial height of about 9 mm through the portion corresponding to surface 134 and a height of about 3 mm at the outer cylindrical surface 92. The knife blade was embedded over its entire body portion 118 and over the adjacent part of the knife portion 120, including about 1 mm of the outer tapered surface and somewhat more of the inner cylindrical surface generally as illustrated in FIGS. 9D–9F. An acetal homopolymer resin sold by EI dupont de Nemours & Co. (Inc.) under the designation DELRIN® II 500 NC 10 has been used successfully for heated injection molding of the body 23 of cup 22 with an insert molding machine.

Thus it will be seen that improvements in ink cups, the methods of their production and the combination of certain pad printing machines with such cups have been provided wherein most of the precision machining heretofore required for forming the ink cups and/or the mounting of knife blade elements in the ink cups have been eliminated. These ink cups can be produced very economically while providing high quality doctoring over the long production lives associated with hard doctor blades in pad printing operations.

From the foregoing it can be seen that apparatus and related methods have been provided which accomplish the aforenoted objects of this invention.

It will be understood that other variations, modifications and the substitution of equivalent mechanisms can be affected within the spirit and scope of this invention, particularly in light of the foregoing teachings. It is contemplated by the following claims to cover any such modifications and other embodiments that incorporate those features which constitute the essential features of the invention within the true spirit and scope of the following claims.

What is claimed is:

1. The method of making an open ended ink cup for a pad printing machine comprising the steps of providing a doctor ring which has a body portion and doctor knife ring portion that extends generally axially of said ring from said body portion, and molding a hollow ink cup body onto said body portion of said doctor ring such that said doctor ring is affixed to said cup body by said molding step, with said doctor knife ring portion surrounding the open end of said cup body and the distal edge of said doctor knife ring portion projecting outward to provide the sealing and doctoring surface of said ink cup.

2. The invention as in claim 1 wherein said molding step comprises injection molding.

3. The invention as in claim 1 wherein said doctor knife ring portion includes a narrow distal edge portion, including the steps of positioning said distal edge portion of said doctor knife ring portion in an annular groove of a die block and injection molding a generally cylindrical cup onto said body portion of said doctor ring.

4. The invention as in claim 3 including applying seating force to said doctor ring in a direction generally axially of said doctor ring and toward said die block and thereby pressing said doctor ring into said annular groove during said molding step.

5. The invention as in claim 1 including molding said cup in a hat-shaped configuration which include an external flange molded onto said doctor ring and a cylindrical wall having an outside diameter which is less than the inside diameter of said doctor ring.

6. The invention as in claim 1 including the steps of providing such a doctor ring formed of a hard material, and molding said cup of plastic.

7. The invention as in claim 6 wherein said ring is formed of carbide.

8. The invention as in claim 7 wherein said cup is injection molded.

9. The invention as in claim 1 including molding said cup in a hat-shaped configuration which comprises a hollow primary body for holding ink and having an open end and an outwardly extending annular flange around said open end of said cup, and molding said cup on said ring with said doctor knife ring embedded in said flange.

10. The invention as in claim 9 including the steps of providing such a doctor ring formed of a hard metal, and molding said cup of plastic.

11. The invention as in claim 10 wherein said ring is formed of carbide.

12. A molded plastic pad printing ink cup for sliding engagement with a cliché, wherein said cup includes a hollow primary body molded of a material suitable for holding cliché printing ink and having an opening through one end, and a doctor blade having a mounting portion which is mold-bonded in said one end of said primary body, said doctor blade including a doctor knife portion which is joined to said mounting portion and extends from said primary body circumjacent said opening and includes a distal doctoring edge for forming a doctoring seal between said ink cup and an abutting cliché surface.

13. The invention as in claim 12 wherein said doctor blade is in the form of a circular ring.

14. The invention as in claim 12 wherein said cup includes an outwardly extending flange around said open end of said primary body and said doctor blade mounting portion is mold-bonded in said flange.

15. The invention as in claim 14 wherein said primary body includes side walls extending generally axially of said cup, said flange extending outwardly from said walls, and said doctor blade is spaced outward relative to said side walls.

16. The invention as in claim 12 wherein said cup includes a hollow circular cylindrical primary body and an outwardly extending flange around said open end of said primary body, said doctor blade being of an annular circular ring shape, said doctor blade having an inner diameter greater than the outer diameter of said circular cylindrical primary body and being disposed with said mounting portion thereof mold-bonded in said flange such that said doctor knife portion is concentric with the extended axis of said cylindrical primary body and spaced radially outward relative to said side walls.

17. The invention as in claim 16 wherein said doctor blade is of uniform axial length throughout its circumference.

18. The invention as in claim 17 wherein said doctor blade is of uniform cross-section throughout its circumference.

19. The invention as in claim 12 wherein said cup is of hat-shaped configuration which comprises an annular flange, a hollow primary body extending in one direction from said flange for holding ink, whereby said flange defines an open end of said cup, and said doctor blade is embedded in the side of said flange opposite said primary body and is spaced outboard of said primary body.

20. The invention as in claim 12 wherein said mounting portion includes a first part that extends through the surface of said primary body at said one end and a second part spaced inward of said body from said surface and which is of a different configuration than said first part.

21. The invention as in claim 20 wherein said second part is of a greater cross-section than said first part as viewed axially of said ink cup.

22. A pad printing machine in which a cliché is reciprocative along a predetermined path, an ink container disposed over the position of such a cliché, said container including a hollow primary body cup molded of a material suitable for holding cliché printing ink and having an opening through one end, said container including a generally vertical side wall and a flange extending radially outward from said side wall and presenting an upwardly exposed flange surface around said container, and a doctor blade having a mounting portion which is mold-bonded in said one end of said flange, said doctor blade including a doctor knife portion which is joined to said mounting portion and extends from said primary body circumjacent said opening and includes a distal doctoring edge for forming a doctoring seal between said ink cup and an abutting cliché surface, and a hold-down mechanism for pressing the said doctor blade against such a cliché, said hold-down mechanism including an annular thrust collar disposed around said container over said flange and movable relative to said container, said thrust collar being in substantially continuous uniform contact with said flange surface around said cup whereby downward pressure is applied on said cup flange by said thrust collar substantially uniformly along the entire circumference of said cup when downward forces are applied to said thrust collar.

23. The invention as in claim 22 wherein said thrust collar includes a rigid ring which includes a thrust surface disposed over said flange, and a resilient force-transfer ring disposed between said thrust and flange surfaces and being in substantially continuous uniform contact with each of said surfaces.

24. The invention as in claim 23 wherein said force transfer ring is formed of a hard slightly resilient plastic material having a transfer surface disposed downward for engaging said flange surface, and said transfer and flange surfaces are formed with the same configuration for such continuous uniform contact with one another around the circumference of said cup whereby forces are transferred from said thrust collar to said flange substantially uniformly along the entire circumference of said container.

25. The invention as in claim 24 wherein said transfer and flange surfaces are truncated conical surfaces which are inclined radially outwardly in a direction away from said thrust surface.

* * * * *